United States Patent [19]

Mallory

[11] Patent Number: 4,869,031

[45] Date of Patent: Sep. 26, 1989

[54] ACCESS SPLINE

[76] Inventor: David Mallory, 155 Northwoods Rd., Manhasset, N.Y. 11030

[21] Appl. No.: 250,948

[22] Filed: Sep. 29, 1988

[51] Int. Cl.[4] ..... E04B 5/55

[52] U.S. Cl. ..... 52/127.8; 52/127.1; 52/484; 52/586

[58] Field of Search ..... 52/779, 484, 489, 586, 52/127.1, 127.7, 127.8

[56] References Cited

U.S. PATENT DOCUMENTS

| | | | |
|---|---|---|---|
| 2,389,965 | 11/1945 | Eckel | 52/484 |
| 2,993,240 | 7/1961 | Ericson | 52/484 |
| 3,359,695 | 12/1967 | Gazerro | 52/127.8 |
| 3,828,508 | 8/1974 | Moeller | 52/489 |
| 3,863,413 | 2/1975 | Mooney | 52/484 |
| 3,875,717 | 4/1975 | Moeller | 52/489 |
| 3,973,368 | 8/1976 | Moeller | 52/484 |
| 4,089,146 | 5/1978 | Martinez | 52/484 |

FOREIGN PATENT DOCUMENTS

| | | | |
|---|---|---|---|
| 642053 | 6/1962 | Canada | 52/127.8 |

*Primary Examiner*—David A. Scherbel
*Assistant Examiner*—Caroline D. Dennison
*Attorney, Agent, or Firm*—David D. Rosenblum

[57] ABSTRACT

The present invention provides an improved access spline that is used in a hung ceiling tile at the abutting edges of the tiles. The access spline of the present invention comprises a flexible strip-like body member having a central slot forming a pair of independently flexing portions from the body member and preferably a pair of depending toggle membes connected to the body member adjacent the slot. The access spline is used with one flexing portion located within an edge groove defined in the abutting edge of the adjoining ceiling tile and with the other flexing portion alternatingly located within a groove segment and a contiguous recessed portion defined in the abutting edge of the access tile. The preferred pair of depending toggle members extend between the abutting edges of the access and adjoining ceiling tiles and below the underside of the ceiling. The toggle members are used to slide the access spline between a latched and an unlatched position in which the other flexing portion is alternately located within the groove segment and the recessed portion to alternately connect and separate the tiles. Additionally, when the access spline is in the unlatched position, the toggle members may be alternately downwardly drawn to deform the access tile and to thereby point out the location of the access tile.

6 Claims, 2 Drawing Sheets

166
169
165
164
160
91a
90
162
30
32

90
94
12
10
180

179
176
175
174
170
93a
172
72
90
70

50
52
99
192
90
196
204
198
202
203
205
190

20
25
14
10
16
82
80
24
22
12
13
85
84
72
35
164
95
174
75
30
34
162
172
32
160
170
90
ACCESS
PANEL
LOWERING
72
10
190
37
36
70
97
98
77
76
64
44
53
52
56
65
40
45
42
54
50
62
60
10

50
196
53
190
194
198
204
202
C
98
203
205
90

ACCESS SPLINE

FIELD OF THE INVENTION

The present invention relates to an access spline for releasably connecting an access tile to an adjoining ceiling tile of a hung ceiling.

BACKGROUND OF THE INVENTION

Hung ceilings normally comprise a plurality of square or rectangular ceiling tiles supported by a plurality of parallel flanged beams, referred to in the art as "T-bars" and "Z-bars", which are in turn suspended below the ceiling of the room. Each of the tiles has a set of peripheral edge grooves defined in its transverse and side edges. Each of the flanged supporting beams has a lower horizontal supporting flange connected along the length of the lower edge of a vertically oriented web. Each of the beams also includes a top flange connected along the length of the upper edge of the web to serve as an attachment point for a plurality of hangers that are in turn connected to the ceiling of the room. The ceiling tiles are arranged in rows between the supporting beams with the the transverse edges of the tiles in a close abutting relationship and with the supporting flanges engaged within the peripheral edge grooves of the tiles located along the opposite side edges of the tiles. Adjoining tiles, in each row, are further connected to one another by a plurality of strip-like mounting splines that simultaneously extend through the peripheral edge grooves of the tiles located at the adjacent abutting transverse edges of the tiles.

Very often, critical building fixtures, such as electrical junctions and air-conditioning ducts are located in the space between the ceiling of the room and the hung ceiling. In order to access such building fixtures, one of the ceiling tiles is modified to form an access tile. The modification to the ceiling tile, to form the access tile, is performed by cutting or breaking a pair of upper portions of the tile that partially form the peripheral edge grooves located along the side edges of the tile so that the access tile is essentially hinged along one of its transverse edges to an adjoining ceiling tile by a mounting spline. Another upper portion of the tile, adjacent the other transverse edge of the tile, is removed to form a recessed portion and a groove segment, contiguous with one another, from the peripheral edge groove located at the other transverse edge of the tile.

The access tile is releasably connected along its other transverse edge to another ceiling tile by the provision of an access spline. The access spline comprises a strip-like body member that has a length, width and thickness such that, in an unlatched position, the access spline is located within the peripheral edge groove of the other adjoining tile and the recessed portion to permit the access tile to be rotated about the mounting spline so as to be either flush with the visible underside of the hung ceiling or in an open position in which the other transverse edge of the access tile is downwardly spaced from the other adjoining ceiling tile. Alternatively, when the access tile is flush with the visible underside of the ceiling, the access spline may be slid to a latched position in which the access spline is located within the groove segment and the peripheral edge groove to connect the access tile and other adjoining ceiling tile to one another.

When the access spline is in latched position, it is difficult to locate the access tile after installation. Moreover, it is difficult to move the access spline between its latched and unlatched positions because, as mentioned above, the transverse edges of the access and ceiling tiles are in a close abutting relationship. As a result, a razor blade is generally employed to move the access spline between its latched and unlatched position. As can be appreciated, this is particularly dangerous for a workman because the razor blade can break or cut the workman. Lastly, even when the access spline is finally moved to its unlatched position and the access tile is rotated into its open position, the transverse edges of the access tile and the other adjoining ceiling tiles may crumble because of their close proximity, thus damaging the access tile and the other ceiling tile.

In order to alleviate the difficulties in positioning the access spline, Moomey U.S. Pat. No. 3,863,413, provides an access spline which is slotted to receive a notched tool that is configured to extend into the slots of the access spline. However, once the access tile is in place and the access spline of Moomey is in the latched position, the same difficulties remain in locating the access tile in the first instance.

Gazerro, U.S. Pat. No. 3,359,695, provides a mechanism that is somewhat different than an access spline, for releasably attaching and hinging an access tile to a hung ceiling. In Gazerro, the access tile is formed by removing upper portions of the transverse edges of the ceiling tile and installing a pair of hinge-like mechanisms to the peripheral edge grooves located along the sides of the tile. The rear portion of the hinge mechanism is connected between the upper and lower flanges of one of the support beams and the front of the hinge mechanism has a pair of depending toggles that extend between adjoining tiles to point out the access tile. The depending toggles move leaf-like sections of the hinge mechanism in and out of contact with the flange of an adjacent support beam to respectively connect and release the access tile from the ceiling.

Although Gazerro accurately points out the access tile by the provision of the depending toggles, it is necessarily more expensive than the slotted access spline of Moomey However, if a toggle were simply attached to a single access spline of Moomey in place of the slots and tool disclosed in Moomey one would still be at a loss to determine which of the tiles, located on either side of the toggle, was the access tile and which tile was the other adjoining ceiling tile. In the prior art, the disadvantage of not knowing the difference between the access tile and the adjoining tile is that often one tries to dislodge the adjoining tile instead of the access tile which results in damage to both tiles.

The present invention solves this problem by fabricating the the body member of the access spline from a strip of flexible material The strip has a central slot and, preferably a pair or depending toggle members which are connected to the access spline opposite one another and adjacent the slot. The toggles allow the access spline to be slid between its latched and unlatched positions through manipulation of the toggles. Additionally, when the access spline is in the unlatched position, the toggle members may be alternately downwardly drawn to deform an edge of the access tile and to thereby point out the access tile relative to the other adjoining ceiling tile. Moreover, when the access spline is in the unlatched position, the toggle members may be used to impart a rocking motion to the access spline in order to dislodge the access tile without damage to the abutting edges of the access tile and the other adjoining ceiling tile.

SUMMARY OF THE INVENTION

The present invention provides an improved access spline of the type that comprises a strip-like body member. The body member is configured to slide between a latched position in which the body member is located within a groove segment and a peripheral edge groove respectively defined in the abutting edges of an access tile and a ceiling tile of a hung ceiling and an unlatched position in which the body member is located within the peripheral edge groove and a recessed portion defined in the abutting edge of the access tile contiguous with the groove segment. When the body member is in the latched position, it connects the access and adjoining ceiling tiles to one another so that the access tile remains in a closed position flush with the underside of the ceiling. When the body member is in the unlatched position, the abutting edges may be separated and the access tile may be downwardly rotated to an open position.

The improvement to the access spline comprises the body member to be fabricated from a flexible material. The body member also has a central slot wherein the slot has a length less than that of the body member and extends from one of the ends of the body member to divide the body member into a pair of independently flexing portions. One portion is adapted to be located within the edge groove and the other portion is adapted to be alternately located within the groove segment and the recessed portion when the body member is slid between its latched and unlatched positions. Additionally, at least one depending toggle member is provided. The toggle member is connected to the other of the portions adjacent the slot. The toggle member is configured to extend between the abutting edges of the access tile and the adjoining ceiling tile and below the underside of the ceiling when the access tile is in the closed position.

When the access tile is in the closed position, the body member may be slid between its latched and unlatched positions by movement of the toggle member. When the body member is in the unlatched position, the at least one toggle member may be downwardly drawn to deform the access tile to indicate the location of the access tile.

DETAILED DESCRIPTION

Figure 1:
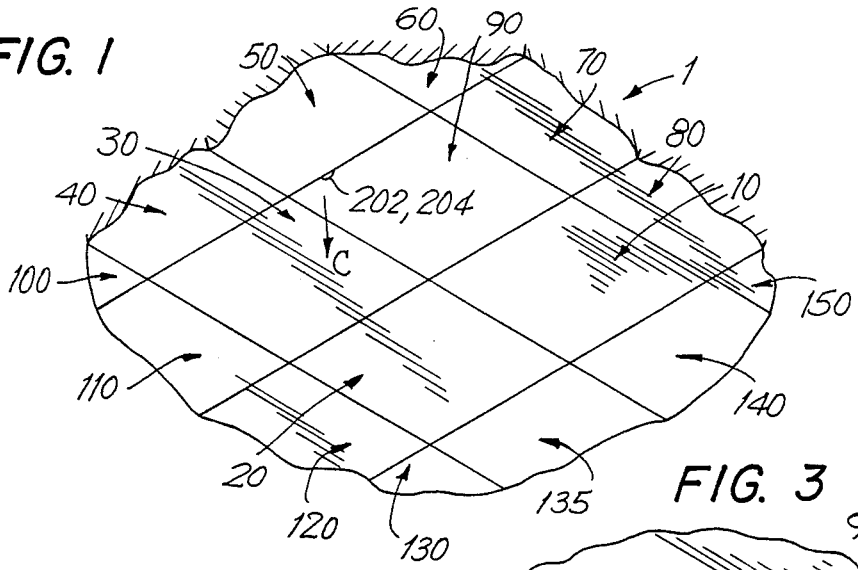
FIG. 1 is a fragmentary bottom perspective view of the underside of a hung ceiling incorporating an access tile and an access spline of the present invention.

With reference to FIGS. 1, 4, 5, 7 and 9, a portion of a hung ceiling 1 is illustrated. The hung ceiling 1 includes a plurality of ceiling tiles 10 20, 30, . . . , 150 incorporating an access tile 90 that will be described in more detail hereinafter. As mentioned previously, the ceiling tiles are supported by a plurality of parallel flanged supporting beams which are illustrated by well known Z-bars 160 and 170. Each of the flanged supporting beams 160 and 170 has a lower horizontal flange, respectively illustrated as 162 and 172, connected along the vertically oriented webs, illustrated as 164 and 174, of the respective beams 160 and 170. Additionally, each of the beams includes a top flange, respectively illustrated as 166 and 176, connected along the length of the upper edge of the webs 164 and 174. As illustrated, the webs 164 and 174 may be provided with bores 165 and 175 to serve as attachment points for a plurality of hangers, illustrated as 169 and 179, that are in turn connected to the ceiling of the room from which the hung ceiling is to be suspended.

Figure 4:
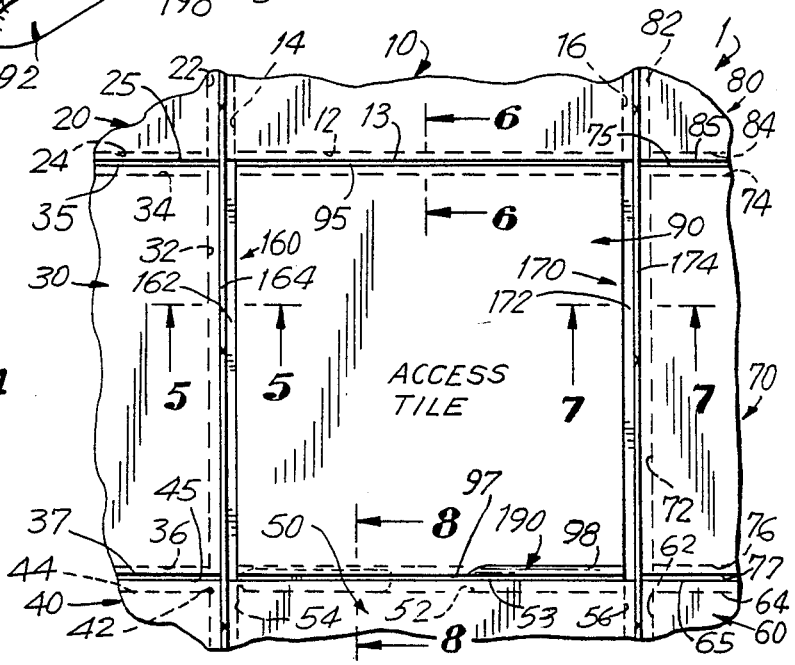
FIG. 4 is a fragmentary top plan view of the hung ceiling illustrated in FIG. 1 with the access spline of the present invention illustrated, by solid lines, in the unlatched position and illustrated, by phantom lines, in the latched position.
Figure 9:
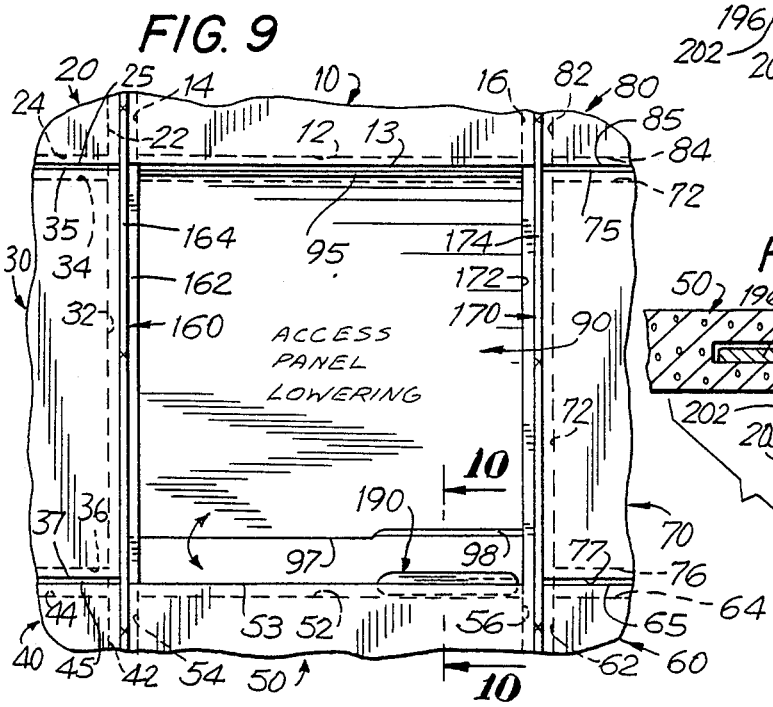
FIG. 9 is a fragmentary top plan view of the hung ceiling illustrated in FIG. 1 with the access spline in the unlatched position and the access tile lowering into open position.

Each of the tiles has a set of peripheral edge grooves defined in its lengthwise and transverse edges. With particular reference to FIGS. 4 and 9, the peripheral edge grooves are respectively illustrated for ceiling tiles 10, 20, 30, . . ., 80 as respectively: 12, 14, 16; 22, 24; 32, 34, 36; 42, 44; 52, 54,56;62, 64; 72, 74,76; and 82, 84. The ceiling tiles 10, 20, 30, . . . , 80 are arranged in rows between the supporting beams, such as the illustrated beams 160 and 170, with the transverse edges of the tiles, for instance, edges 25 and 35, edges 37 and 45, edges 65 and 77 and edges 75 and 85 in a close abutting relationship. The lower horizontal flanges 162 and 172 of the supporting beams are engaged in the peripheral edge grooves, 14, 22, 32, 42, 54, 56, 62, 72, 82 and 16 of the respective tiles 10, 20, 30, . . . , along the opposite lengthwise side edges of the tiles.

Figure 6:
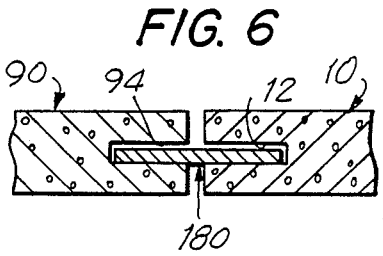
FIG. 6 is a cross-sectional view of FIG. 4 taken along line 6—6.

With additional reference to FIG. 6, adjoining tiles in each row, are further connected to one another by a plurality of strip-like mounting splines that simultaneously extend through the peripheral edge grooves of the tiles at adjacent abutting transverse edges of the tile. For instance, ceiling tile 10 is illustrated as being connected to the tile 90, which in the illustration happens to be the access tile but could be any other tile, by a mounting spline 180 that extends between tiles 10 and 90 and is located within the peripheral edge grooves 12 and 94 of the tiles 10 and 90 at adjacent abutting transverse edges 13 and 95 of the respective tiles 10 and 90.

Figure 3:
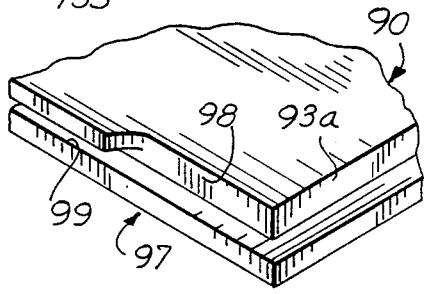
FIG. 3 is a fragmentary perspective view of an access tile.
Figure 5:
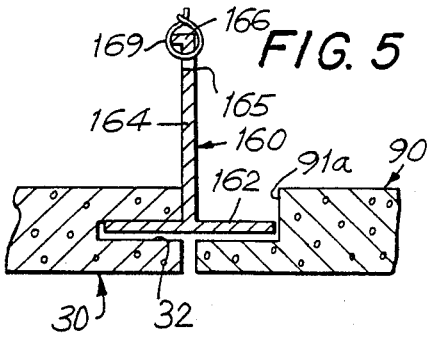
FIG. 5 is a cross-sectional view of FIG. 4 taken along line 5—5.
Figure 7:
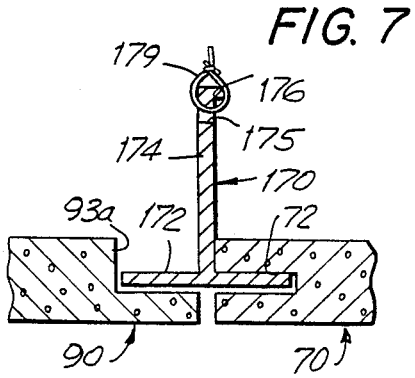
FIG. 7 is a cross-sectional view of FIG. 4 taken along line 7—7.

Referring now also to FIGS. 5 and 7, the access tile 90 is formed by modifying a ceiling tile. As illustrated, a pair of upper portions of the tile 90 are removed to form recessed portions 91a and 93a so that the access tile 90 is essentially hinged along its transverse edge 95 to the adjoining ceiling tile 10 by the mounting spline 180. With further reference to FIG. 3, another upper portion of the tile, adjacent to the other transverse edge 97 of the tile 90, are removed to form a recessed portion 98 contiguous with the remaining segment of groove 99 located in transverse edge 97.

With continued reference again to FIG. 1 and also to FIG. 9, as has been mentioned previously, the access tile may be rotated as indicated by double arrowhead A, about the mounting spline 180 between a closed position, as illustrated in FIG. 1, with the access tile 90 flush with the visible underside of the hung ceiling 1 and with edge 97 in a close abutting relationship with edge 53 of tile 50; and an open position, illustrated in FIG. 9; in which the edge 97 is downwardly spaced from edge 53. In the open position, the access tile 90 may be removed from the ceiling 1 to obtain access to critical building fixtures such as air conditioning ducts, electrical fixtures and the like.

Figure 2:
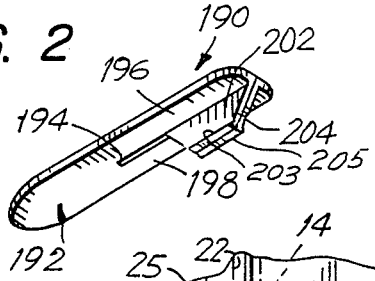
FIG. 2 is a perspective view of the access spline of the present invention.
Figure 8:
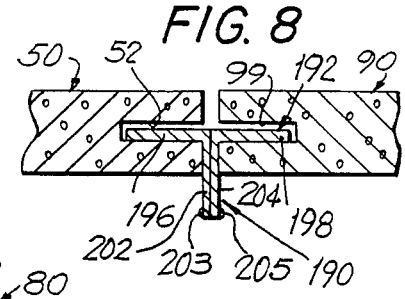
FIG. 8 is a cross-sectional view of FIG. 4 taken along line 8—8.

In the prior art, as mentioned previously, access splines have been provided to connect an access tile, such as illustrated by 90 to another adjoining ceiling tile, such as illustrated by ceiling tile 50 along their adjacent, abutting transverse edges such as 97 and 53. With reference to FIG. 2, the access spline 190 of the present invention includes a planar body member 192 that comprises an elongated flexible strip that is configured as prior art access splines, to be slid between the unlatched and latched positions. In the unlatched position, illustrated in FIG. 9, the body member 192 extends between tiles 50 and 90 and is located within the recessed portion 98 and a portion of the peripheral edge groove 52 defined in the transverse edge 53 of the succeeding adjoining ceiling tile 50. In this unlatched position of the access spline 190, the access tile 90 is free to rotate in the direction of arrow A, about the mounting spline 180, between its open and closed positions. With reference to FIG. 8, in the latched position, body member 192 is located within peripheral edge groove 52 and the groove segment 99. Since the body member 192 continues to extend between tiles 50 and 90, the tiles are connected to one another.

As is well known in the art, in order to allow the spline 190 to assume its latched and unlatched positions, the body 192 must be no longer than the recessed portion 98 and must be no wider than the combined depths of the grooves 52 and 99. In order to allow the body member 192 to be slid along the grooves, the body member 192 must be no thicker than the thickness of the grooves 52 and 99. The body member is provided with an elongated central slot 194 that has a length that is less than the length of the body member 192 and that extends from one of the ends of the body member. The slot divides the body member 192 into a pair of independently flexing portions 196 and 198. One portion, 196 may be located in the edge groove 52 and the other portion 198 may be alternately located within the groove segment 99 and the recessed portion 98 when the access spline is slid between its latched an unlatched positions.

The access spline of the present invention 190 also preferably includes a pair of depending toggle members 202 and 204 that are configured and connected to the portions 196 and 198 adjacent slot 194 such that when the access tile is in either of its latched and unlatched positions, the toggle members 202 and 204 are able to extend between the abutting transverse edges 53 and 97 are are visible below the underside of the ceiling.

Figure 10:
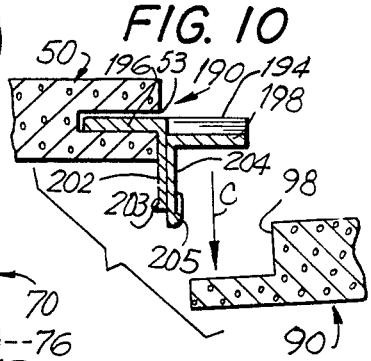
FIG. 10 is a cross-sectional view of FIG. 9 taken along line 10—10.

With reference to FIG. 9, when the access spline is in the unlatched position, the toggle members 202 and 204 may be separately downwardly drawn in the direction of arrow C (see also FIG. 1), until tile 90 deforms to point out the access tile. Subsequently, the toggle members 202 and 204 may be manipulated to impart a rocking motion to the access spline 190 and, as illustrated in FIG. 10, downwardly drawing toggle 204 in order to gently dislodge the access tile 90 from the adjacent tile 50 without damage to either of the tiles. In this regard, in order to allow the portions 196 or 198 to properly flex during the downward movement of the toggle member without producing a permanent deformation in the access spline 190; and further in order to insure a sufficient rigidity of the access spline during rocking, the length of the slot 194 is preferably about one-half the length of the body member 192. Furthermore, as an aid in manual manipulation of the toggle members 202 and 204, the toggle members on their outer surfaces may preferably be provided with the illustrated oppositely directed finger grips 203 and 205.

It is possible to form an embodiment of the access spline 190 of the present invention that only employs a single toggle member such as illustrated as toggle member 204. In such an embodiment the access spline wold be used by positioning the access spline 190 such that the portion 198 is initially located within the recessed portion 98 to allow the toggle member 204 to be downwardly drawn to deform and thereby point out access title 90. Such an embodiment would not be preferred in that it would be more complex to use the access spline and moreover, the use of a pair of toggle members presents an increased stiffness over a single toggle member when rocking the access spline I.

As can be appreciated by those skilled in the art, the access spline of the present invention can be formed from sheet metal of an appropriate thickness relative to the peripheral grooves of the tile so that the body portion 192 may slide within the grooves and the toggles may depend between adjacent transverse edges of the tiles. Similarly, the access spline of the present invention may be formed in accordance with well known plastic forming techniques from, for instance, nylon.

While specific embodiments of the invention have been shown and described, the invention should not be considered as so limited but only as limited as in the appended claims.

I claim:

1. In an access spline of the type that comprises an elongated strip-like body member configured to slide between a latched position in which said body member is located within a groove segment and a peripheral edge groove respectively defined in the abutting edges of an access tile and a ceiling tile of a hung ceiling so that said access and ceiling tiles are connected to one another and said access tile thereby remains in a closed position, flush with the underside of said ceiling, and an unlatched position in which said body member is located within said peripheral edge groove segment and a recessed portion, defined in said abutting edge of said access tile contiguous with said groove segment so that said abutting edges may be separated and said access tile may thereby be downwardly rotated to an open position, the improvement comprising:

said body member fabricated from a flexible material and having a central slot wherein said slot has a length less than that of said body member and extends from one of the ends of said body member so as to divide said body member into a pair of independently flexing portions, one said portion adapted to be located within said edge groove and the other said portion adapted to be alternatively located within said groove segment and said recessed portion when said body member is slid between its said latched and unlatched positions; and at least one depending toggle member connected to said other portion adjacent said slot and configured to extend between said abutting edges of said access and adjoining ceiling tiles and below the underside of said ceiling when said access tile is in the closed position, whereby said body member may be slid between its said latched and unlatched positions by movement of said at least one toggle member and, when said body member is in the unlatched position, said toggle member may be downwardly drawn to deform said access tile to indicate the location of said access tile.

2. The improvement of claim 1 wherein a pair of said toggle members are respectively connected to said one and said other portions adjacent said slot and opposite to one another such that such toggle members may, alternately, be downwardly drawn, when said access spline is in the latched position, to indicate the location of said access tile.

3. The improvement of claim 2 wherein said toggle members are located at said one end of said body member.

4. The improvement of claim 3 wherein said toggle and said body members are integrally formed.

5. The improvement of claim 1 wherein said slot has a length equal to about half that of said body member.

6. The improvement of claim 4 wherein said slot has a length equal to about half that of said body member.

* * * * *